US006266970B1

(12) United States Patent
Nam et al.

(10) Patent No.: US 6,266,970 B1
(45) Date of Patent: Jul. 31, 2001

(54) VERTICAL PARTITION COVER ASSEMBLY OF SIDE-BY-SIDE TYPE REFRIGERATOR

(75) Inventors: Jeong-Man Nam; Jae-Sek Oh; Suk-Ho Jang, all of Kwangju (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/514,211

(22) Filed: Feb. 28, 2000

(30) Foreign Application Priority Data

Aug. 26, 1999 (KR) ..... 99-35649

(51) Int. Cl.[7] ..... F25B 47/00
(52) U.S. Cl. ..... 62/277; 312/406
(58) Field of Search ..... 62/277, 275, 444, 62/447; 312/406, 406.2, 407

(56) References Cited

U.S. PATENT DOCUMENTS 3,835,660 9/1974 Franck .
3,984,223 * 10/1976 Whistler et al. ..... 62/277 X
4,150,518 * 4/1979 Truesdell et al. .
4,192,149 * 3/1980 Webb ..... 62/277 X
4,197,718 * 4/1980 Abraham et al. ..... 62/277 X
4,330,310 * 5/1982 Tate, Jr. et al. ..... 62/275
4,884,415 12/1989 Mandel et al. .
5,255,531 * 10/1993 Williams et al. ..... 62/277

* cited by examiner

*Primary Examiner*—Henry Bennett
*Assistant Examiner*—Chen-Wen Jiang
(74) *Attorney, Agent, or Firm*—Larson & Taylor PLC

(57) ABSTRACT

A vertical partition cover assembly of a side-by-side type refrigerator includes a cover (70) coupled to the front of a vertical partition (20) and a fixing member (80) for fixing a hot tube (60) to the inside of the cover (70). The cover (70) includes a sealing surface (75) to closely contact gaskets and a mechanism (41) which holds the sealing surface to the front of the vertical partition. In one embodiment, the mechanism includes connecting portions (76,77) extending inward from both ends of the sealing surface (75), and a pair of pocket portions (71,72) formed at each end of the connecting portions (76,77) to hold the front ends (23,24) of liners (21,22) forming the vertical partition (20). The fixing member (80) includes a concave portion (81) for holding the hot tube (60) tightly in contact with the sealing surface (75), and a pair of elastic portions (82,83) extending to the inside of the vertical partition (20) from both ends of the concave portion (81) to be fitted elastically to the inner ends of the respective pocket portions (71,72).

9 Claims, 6 Drawing Sheets

VERTICAL PARTITION COVER ASSEMBLY OF SIDE-BY-SIDE TYPE REFRIGERATOR

FIELD OF THE INVENTION

The present invention relates to a side-by-side type refrigerator, and more specifically to a vertical partition cover assembly of a side-by-side type refrigerator which is mounted on the front of a vertical partition to hold hot tubes for preventing condensation of moisture adjacent the front doors.

BACKGROUND OF THE INVENTION

In general, a refrigerator is an appliance which is utilized to keep various foods in a fresh state by supplying refrigerant generated from an evaporator to food storing compartments. Recently, there is increasing a demand for large-sized refrigerators for the convenience thereof.

Most domestic large-sized refrigerators are of a side-by-side type which has a vertical partition by which the cabinet forming the framework of a refrigerator is divided lengthwise into refrigerating and freezing compartments. Accordingly, the doors which are mounted on the fronts of each compartment are also arranged side by side. The doors are swung by hinges which are mounted at the front corners of the cabinet.

On the inner surfaces of the doors are provided gaskets of a rubber material to seal the compartments from the outside air. The gaskets are attached to the edge of each door's inner surface which contacts the front surface of the cabinet so that when the doors are closed, the gaskets keep the front surface of the cabinet airtight so that the cool air in the compartments does not leak outside. In the gaskets there are mounted permanent magnets to closely adhere the doors to the front metal surface. Further, hot tubes are laid in the front surface of the cabinet to prevent condensation of moisture due to the temperature difference between the compartments and the outside air.

FIG. 1 shows a front portion of a vertical partition of a side-by-side type refrigerator according to a prior art, in which a hot tube is mounted. The vertical partition 2, by which a storing space is divided into the right and left compartments 1, includes a heat-insulation wall 2*e* which is made by foaming urethane liquid, liners 2*a*,2*b* of a plastic material disposed at both sides of the heat-insulation wall 2*e*, and a cover 3 joining the front ends of the liners 2*a*,2*b*.

The front ends of the liners 2*a*,2*b* are bent so as to face each other and have fixing grooves 2*c*,2*d* of a semi-circle shape, respectively, to fix a pair of hot tubes 5. The cover 3 includes a flat sealing surface 3*c* forming a front of the cover 3 and pocket portions 3*a*,3*b* which extend inward from both the ends of the sealing surface 3*c* and open toward the side direction. The fixing grooves 2*c*,2*d* with the hot tube 5 therein are inserted into the respective pocket portions 3*a*,3*b*, so that the cover 3 is mounted on the vertical partition 2.

At the front of the vertical partition 2 are disposed doors 4L,4R to close and open the storing compartments 1. In order to adhere the doors 4L,4R closely to the vertical partition 3 when the doors 4L,4R are closed, gaskets 4*a* are attached to the edge portions of the inner surfaces of the doors 4L,4R in contact with the vertical partition 2. In the gaskets 4*a* are mounted permanent magnets 4*b* to further reinforce the sealing of the doors 4L,4R to the sealing surface 3*c* of a metal material.

The prior art vertical partition 2 is assembled according to the following process: the hot tubes 5 are inserted into the respective fixing grooves 2*c*,2*d* which are provided at the front ends of the left and right liners 2*a*,2*b*, and then the fixing grooves 2*c*,2*d* are inserted into both the pocket portions 3*a*,3*b* to thereby couple the cover 3 to the front ends of the liners 2*a*,2*b*. In this state, if urethane is foamed inside of the space formed by the liners 2*a*,2*b* and the cover 3, the heat-insulation wall 2*e* is formed and the cover 3 is fixed firmly.

In a conventional side-by-side type refrigerator having the aforementioned vertical partition 2 and cover 3, when the doors 4L,4R are closed, the gaskets 4*a*, which are mounted on their inner surfaces, are adhered airtightly to the sealing surface 3*c* of the cover 3 by the permanent magnets 4*b*. In this state, because heat from the hot tubes S is radiated outside through the sealing surface 3*c* of the cover 3, condensate moisture at the front surface of the vertical partition 2 is prevented due to the temperature difference between the compartments 1 and the outside air.

However, such a conventional structure of the vertical partition and cover of a side-by-side type refrigerator can not effectively prevent condensation of moisture because the two hot tubes which are arranged side by side are structurally separated from the sealing surface of the cover so that the heat from the hot tubes is not efficiently transmitted to the sealing surface.

Further, the conventional structure has disadvantages in that its manufacturing cost and process are increased because it requires the two hot tubes which are arranged side by side.

Furthermore, the cover may be deformed by a sudden closing of the doors or an external impact because the pocket portions of the cover can not be filled with the urethane foam so that structurally the rigidity of the cover is relatively weak.

BRIEF SUMMARY OF THE INVENTION

The present invention has been made in an effort to solve the above problems. It is therefore an object of the present invention to provide a vertical partition cover assembly of a side-by-side type refrigerator which has a further improved cover structure by which condensation of moisture is more effectively prevented, manufacture and assembly are simplified, and rigidity thereof is increased.

To achieve the above object, the vertical partition cover assembly according to a first embodiment of this invention comprises a cover which is coupled to the front surface of a vertical partition and a fixing means or discrete fixing member for fixing a hot tube to the inside of the cover.

The cover includes a sealing surface forming a plane to contact gaskets, and a mechanism which holds the sealing surface to the front ends of the liners. Preferably, the mechanism includes connecting portions extending inward from both ends of the sealing surface, and a pair of pocket portions formed at each end of the connecting portions and opened outward to hold the front ends of liners of the vertical partition. The fixing member is mounted by being inserted between the pocket portions. Each pocket portion has a clip section for grasping the front end of the liner elastically.

The fixing member includes a concave portion for holding the hot tube in such a manner that the tube is in contact with the sealing surface, and a pair of elastic portions extending to the inside of the vertical partition from both ends of the concave portion to be fitted elastically to the inner ends of the respective pocket portions. A number of holes are formed in the fixing member to allow the space between the pocket portions and the sealing surface to be filled with urethane foam when forming the heat-insulation wall.

As another embodiment of this invention, the fixing member is a porous block having a plurality of through holes thereon which is inserted laterally between both of the pocket portions to allow the hot tube to contact the sealing surface closely, and to allow the space between the pocket portions and the sealing surface to be filled with the urethane foam.

As still another embodiment of this invention, the cover assembly comprises a cover which is fitted to the front of the vertical partition to hold the hot tube, and the cover includes a flat sealing plate which makes contact with the gaskets.

The cover of the still another embodiment also includes fitting clip sections or slots formed at both sides of the cover to hold the front ends of the respective liners and a fixing concavity formed at the front surface of the cover to hold the hot tube. The sealing plate is of a magnetic material and the front edge of the cover extends forward to seat the sealing plate.

BRIEF DESCRIPTION OF THE SEVERAL VIEWS OF THE DRAWINGS

Further objects and other advantages of the present invention will become apparent from the following description in conjunction with the attached drawings, in which.

DETAILED DESCRIPTION OF INVENTION

A preferred embodiment of the present invention will now be described in detail with reference to the accompanying drawings.

Figure 1:
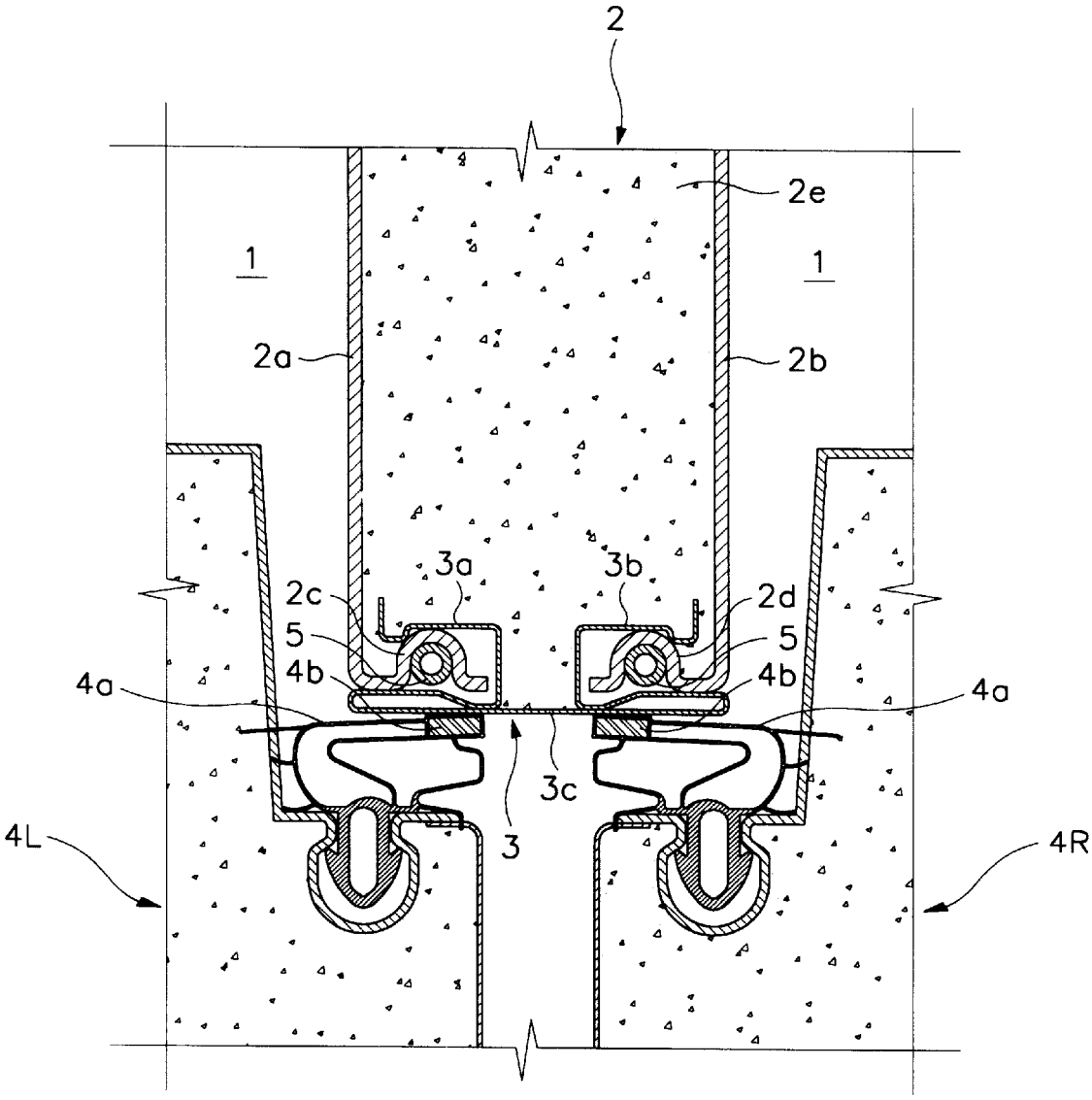
FIG. 1 (PRIOR ART)
FIG. 1 is a cross-sectional top plan view showing a front portion of a vertical partition of a side-by-side type refrigerator according to a prior art.
Figure 2:
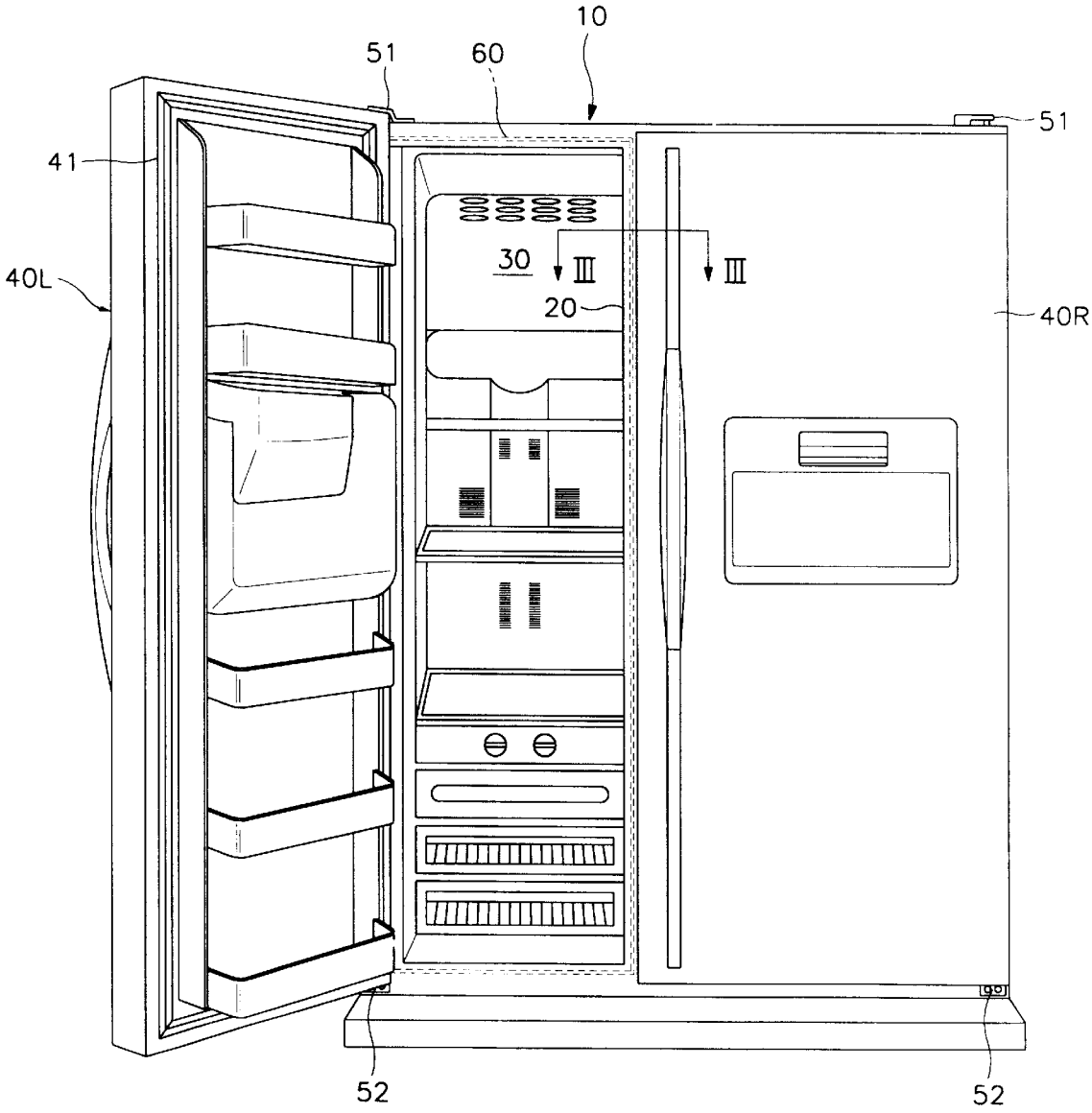
FIG. 2 is a perspective elevation view of a side-by-side type refrigerator to which this invention is applied.

FIG. 2 illustrates a side-by-side type refrigerator which includes a cabinet 10 which has food storing space therein, and a vertical partition 20 which is arranged lengthwise in the cabinet 10 so as to have storing compartments 30 in the right and left sides. At the front of the storing compartments 30 left and right doors 40L,40R are mounted for opening and closing the respective storing compartments 30. The doors 40L,40R are rotatably fitted to the cabinet 10 by hinges 51,52 provided on the front comers of the cabinet 10. Gaskets 41 are attached to the edges of the inner surfaces of the doors 40L,40R to seal the compartments 30 airtightly when the doors 40L,40R are closed. In order to prevent condensation of moisture due to the temperature difference between the compartments 30 and the outside air, hot tubes 60 which are connected to a condenser (not shown) are fitted to front portions of the cabinet 10 and vertical partition 20. When a refrigerant of high temperature and pressure from the condenser flows through the hot tubes 60, heat is transmitted to the front portions of the cabinet 10 and vertical partition 20. Therefore, the temperature difference between the front portions and the outside air is decreased, and as a result condensing water is not formed on the front portions.

Figure 3:
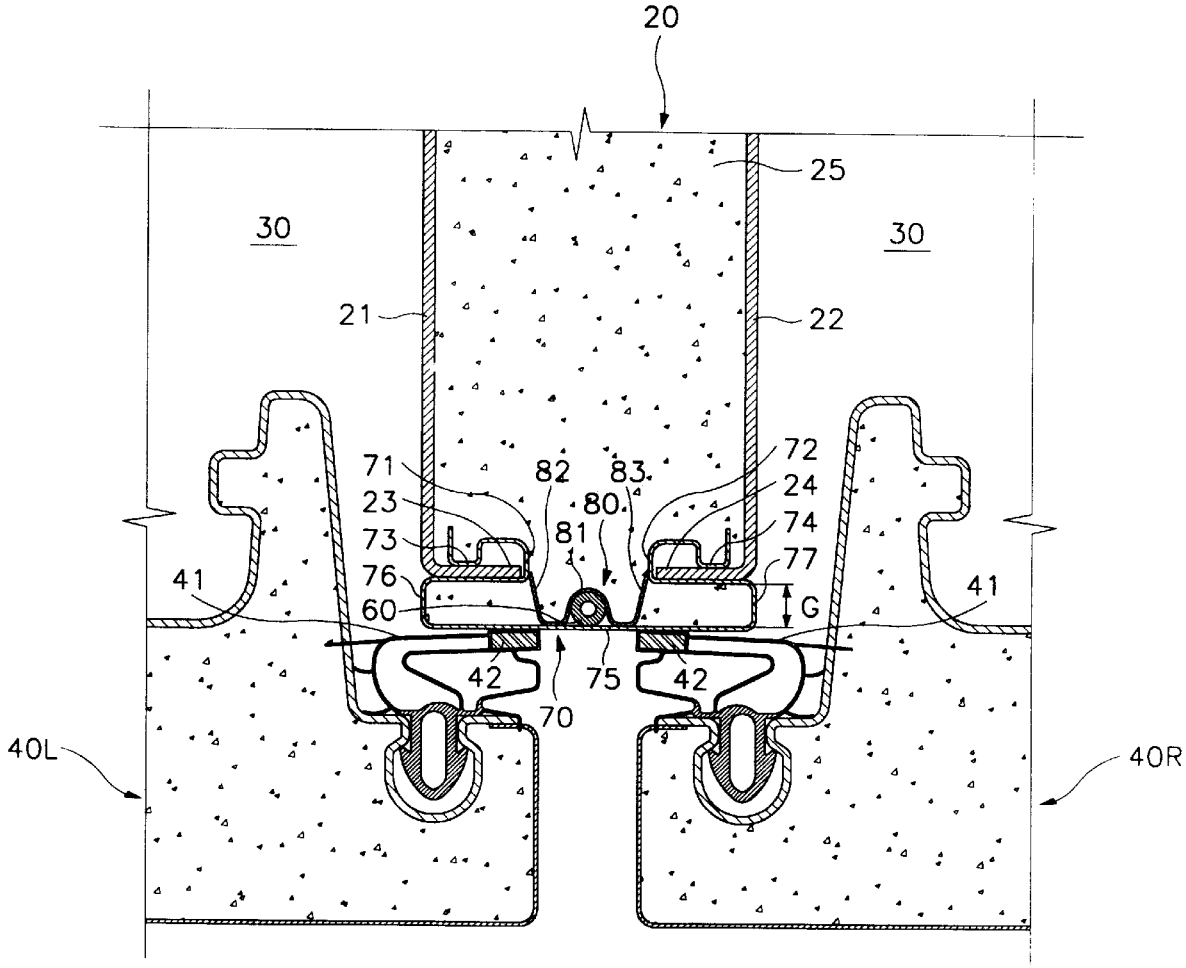
FIG. 3 is a cross-sectional plan view showing a front portion of a vertical partition according to a first embodiment of this invention, which is taken along the line III—III of FIG. 2.
Figure 4:
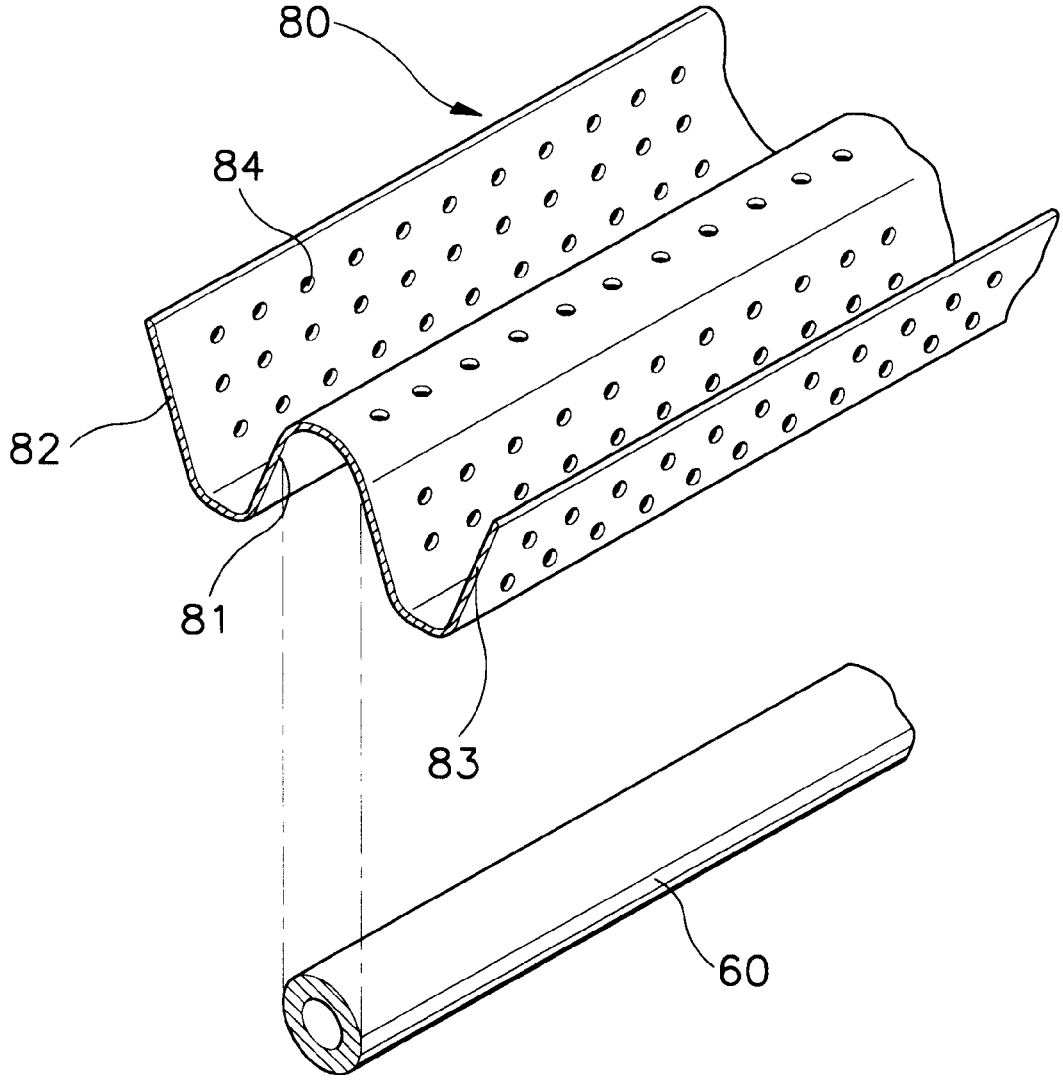
FIG. 4 is a perspective view of a fixing member which is shown in FIG. 3.

FIGS. 3 and 4 illustrate the first embodiment of this invention. The vertical partition 20 includes a pair (left and right) of liners 21,22 defining a side surface of each storing compartment 30 and a heat-insulation wall 25 which is made by foaming urethane liquid between the liners 21,22. On the front of the vertical partition a vertical partition cover assembly is mounted according to this invention. The cover assembly comprises a cover 70 which is fitted to the front of the vertical partition 20 and a fixing means in the form of a discrete fixing member 80 which is fitted to the inside of the cover 70 to fix the hot tube 60 in place.

The cover 70, which is preferably made by forming a metal plate, includes a flat sealing surface 75, and a mechanism which holds the sealing surface 75 to the front ends 23 of the liners 21, 22. The mechanism is preferably formed integrally with the sealing surface 75 and includes left and right connecting portions 76,77 extending inward from both ends of the sealing surface 75, and a pair (left and right) of pocket portions 71,72 provided at the ends of the connecting portions 76,77 and opened toward an outer side. When the doors 40L,40R are closed, the sealing surface 75 is in contact with the gaskets 41 attached to the inner surfaces of the doors 40L,40R so that the cool air in the storing compartments 30 does not leak outside. Permanent magnets 42 are provided in the gaskets 41 so that the doors 40L,40R adhere closely to the sealing surface 75 which is made of a corresponding magnetic metal or material.

The front ends 23,24 of the respective liners 21,22 are bent inward as shown in order to be inserted into the respective pocket portions 71,72. At the inlets of the pocket portions 71,72 clip sections 73,74 are formed which are made by reducing the widths of the inlets of the pocket portions 71,72. The clip sections 73,74 grasp the front ends 23,24 of the liners 21,22 elastically, thereby fixing the cover 70 to the vertical partition 20. The length G of the connecting portions 76,77, which connect the sealing surface 75 with the pocket portions 71,72, has a sufficient size so that the urethane foam permeates into the cover 70completely when insulation wall 25 is formed.

As aforementioned, the hot tube 60 is disposed on the sealing surface 75 of the cover 70 for preventing condensation of moisture. In order to fix the hot tube 60 to the inside of the sealing surface 75, a fixing means in the form of the discrete fixing member 80 is arranged laterally between the pocket portions 71,72 and adjacent the inside of the sealing surface 75. As shown in FIG. 4, the fixing member 80 is formed in a 'W' shape and has a number of holes 84therein. The "W" shape includes a concave portion 81 at the center of the fixing member 80 for holding the hot tube 60 and making the tube 60 contact the inside of the sealing surface 75, and a pair (left and right) of elastic portions 82,83 extending outward from both ends of the concave portion 81. In the position where the concave portion 81 holding the hot tube 60 therein is in contact with the inside of the sealing surface 75, the elastic portions 82,83 are elastically pressed against the inner ends of the pocket portions 71,72(See FIG. 3). It is preferable that the discrete fixing member 80 be made of an elastic and non-conducting substance in order to be easily mounted between the pocket portions 71,72 and to efficiently transmit heat from the hot tube 60 to the sealing surface 75 of the cover 70.

The following is a description on the process of assembling the cover assembly and vertical partition constructed as mentioned above with a side-by-side type refrigerator.

First, when the front ends 23,24 of the liners 21,22 are inserted into the respective pocket portions 71,72 of the cover 70, clip sections 73,74 widen elastically and grasp the front ends 23,24, thereby fixing the liners 21,22 to the cover 70 firmly.

In this state, one hot tube 60 is placed longitudinally on the inside of the sealing surface 75, and then the fixing member 80 is pushed into the lateral space formed between the pocket portions 71,72 so that the hot tube 60 is located in the concave portion 81 of the fixing member 80. As a result, the fixing member 80 with the hot tube 60 is in contact with the inside of the sealing surface 75 and the elastic portions 82,83 of the fixing member 80 are elastically supported by the inner ends of the respective pocket portions 71,72.

Next, when the lateral space between the liners 21,22, is filled with urethane foam in order to form the heat-insulation wall 25, the inside of the cover 70 is also filled with urethane foam through the number of holes 84 provided in the fixing member 80, so that the cover assembly is fixed firmly to the vertical partition 20. That is, because the urethane foam permeates into the space between the pocket portions 71,72 and the sealing surface 75 through the holes 84 of the fixing member 80, the hot tube 90 is fixed tightly in contact with the inside of sealing surface 75. As a result, the sealing surface 75 of the cover 70 is not easily deformed by even strong external impacts.

When a refrigerant of high temperature and pressure from the condenser flows through the hot tube 60 which is fixed to the vertical partition 20 by the cover assembly made as aforementioned, heat is radiated from the hot tube 60 and transmitted to the sealing surface 75 of the cover 70, thereby preventing condensation of moisture due to the temperature difference between the storing compartments 30 and the outside air. In particular, because the hot tube 60 is in contact with the inside of the sealing surface 75 and the fixing member 80 holding the hot tube 60 is made of a non-conducting substance, the heat radiated from the hot tube 60 is effectively transmitted to the sealing surface 75. Accordingly, only one hot tube provides the amount of heat required in the sealing surface 75 to prevent condensation of moisture.

Figure 5:
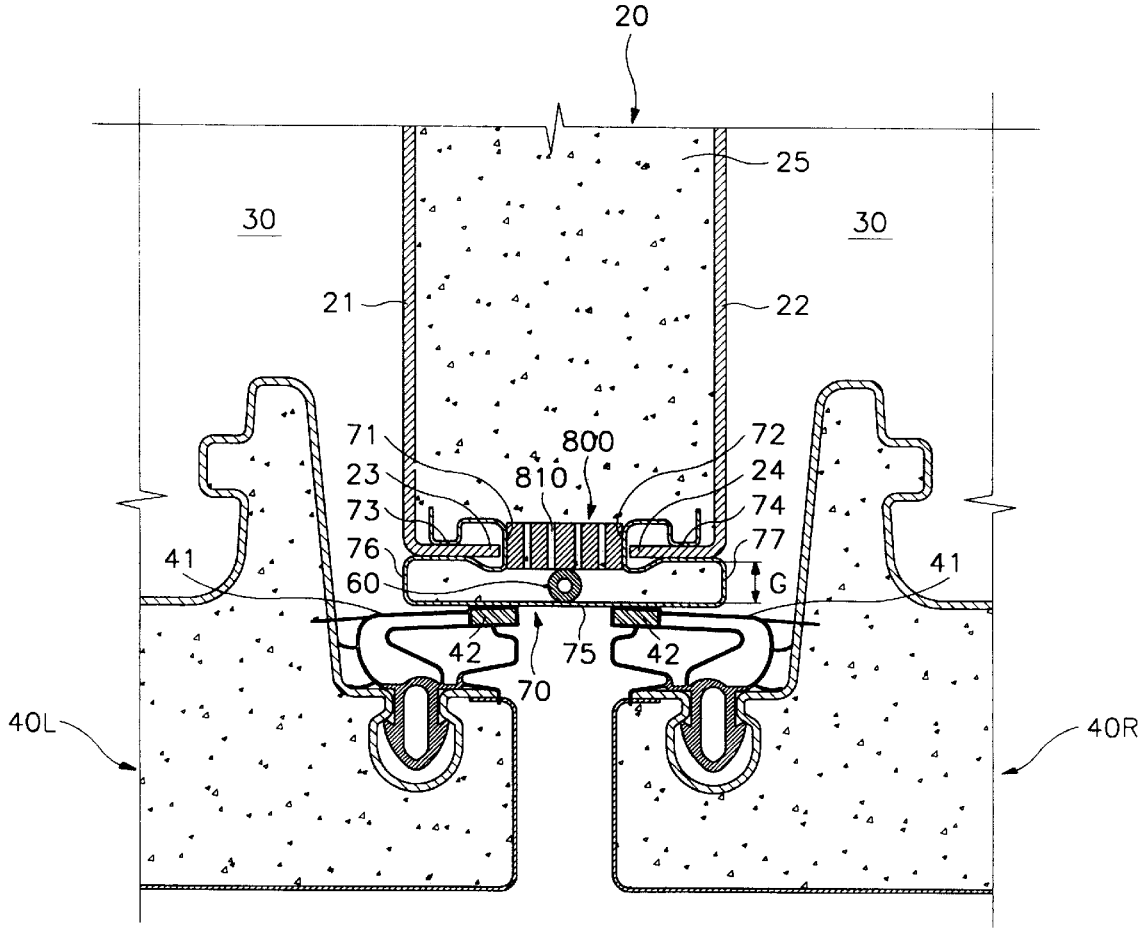
FIG. 5 is a cross-sectional plan view showing a front portion of a vertical partition according to a second embodiment of this invention.

FIG. 5 illustrates the second embodiment of this invention. In this embodiment, a fixing member 800 is made as a porous block instead of the fixing member 80 of a 'W' shape in the first embodiment. The fixing member 800 of the second embodiment is also positioned tightly into the lateral space between the inner ends of the pocket portions 71,72 to fix the hot tube 60 to the inside of the sealing surface 75. The fixing member 800 has a number of through holes 810 to allow urethane foam to permeate into the inside of the cover 70 when the insulation wall 25 is formed.

Other than the structure aforementioned, the cover assembly according to the second embodiment is substantially the same as that of the first embodiment and thus need not be discussed further.

Figure 6:
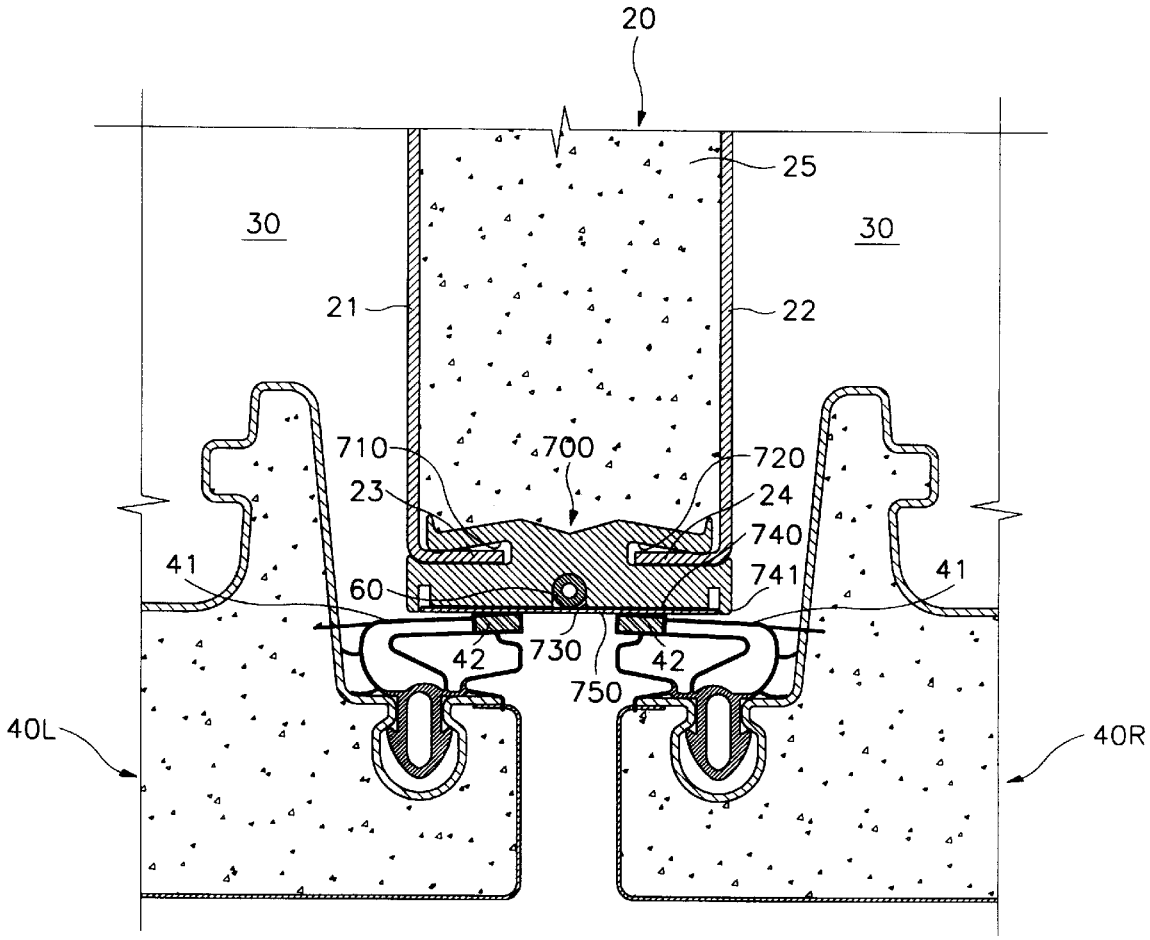
FIG. 6 is a cross-sectional plan view showing a front portion of a vertical partition according to a third embodiment of this invention.

FIG. 6 illustrates the third embodiment of this invention. The cover assembly according to this embodiment comprises a cover 700 which is fitted to the front of the vertical partition 20 and which includes a sealing plate 750 which is attached at the front of the cover 700. The cover 700 is made of an extruding-molded PVC and includes fitting clip sections or slots 710,720 formed at both (left and right) sides of the cover 700 to hold the front ends 23,24 of the respective liners 21,22, and a fixing means preferably formed as fixing concavity 730 formed at the front of the cover 700 to hold the hot tube 60. The sealing plate 750 is made of a flat magnetic material. The opposed front edges 741 of the cover 700 extends forward as much as the thickness of the sealing plate 750 so as to form a seat portion 740 inside the front edge 741. Thus, the sealing plate 750 is easily attached to the seat portion 740 utilizing adhesive agents like a double-faced tape. The hot tube 60 is fixed in the fixing concavity 730 of the cover 700 and is thereby disposed in contact with the sealing plate 750.

The following is a description on the process of assembling the cover assembly and vertical partition constructed as mentioned above in a side-by-side type refrigerator.

First, the front ends 23,24 of the liners 21,22 are inserted into the respective fitting slots 710,720 and the hot tube 60 is inserted into the fixing concavity 730. Next, the sealing plate 750 is attached in the seat portion 740 formed on the front of the cover 700 utilizing a double-faced tape or other adhesive agent. In this state, the lateral space between the liners 21,22 is filled with urethane foam in order to form the heat-insulation wall 25. As a result, the cover assembly is fixed to the vertical partition 20 firmly.

In the cover assembly according to this embodiment, the function of the hot tube 60 is the same as those in the first and second embodiments.

As described in detail above, the vertical partition cover assembly of a side-by-side type refrigerator according to this invention has advantages in that (a) the assembling process is improved because the vertical partition cover assembly has a structure easy to be mounted on a vertical partition, (b) the manufacturing cost is reduced because only one hot tube is required, and (c) the front of the vertical partition is not easily deformed even if there are external impacts thereon because a heat-insulation or PVC material is used to fill the inside of the cover.

What is claimed is:

1. A side-by-side type refrigerator comprising:

a cabinet, a vertical partition in the cabinet forming left and right storing compartments on left and rights sides thereof, the vertical partition including (a) left and right liners having respective front ends, and (b) a heat-insulation wall between the liners;

left and right doors mounted to the cabinet and having respective gaskets on inner surfaces thereof, the left and right doors opening and closing to provide access to the respective left and right compartments; and a vertical partition cover assembly which covers a front of the vertical partition, the vertical partition cover assembly including (a) a cover which includes (i) a sealing surface forming a plane of contact for the gaskets, and (ii) a mechanism which holds the sealing surface to the respective front ends of the liners, the mechanism including left and right connecting portions extending inward from respective left and right ends of the sealing surface, and left and right pocket portions formed at respective left and right ends of the respective left and right connecting portions, the left and right pocket portions opening outward to couple associated front ends of the respective left and right liners thereto, (b) a hot tube, and (c) a fixing means for fixing the hot tube inside of the sealing surface and laterally between the respective front ends of the liners, the fixing means being a discrete fixing member which is mounted between the pocket portions by the mechanism.

2. The refrigerator as claimed in claim 1, wherein each of the pocket portions includes a clip section by which the associated front ends of the liners are respectively grasped elastically.

3. The refrigerator as claimed in claim 1, wherein the discrete fixing member includes (a) a concave portion which holds the hot tube in contact with the sealing surface, and (b) respective left and right elastic portions extending to an inside of the vertical partition from respective left and right ends of the concave portion and fitted elastically to respective inner ends of the respective left and right pocket portions.

4. The refrigerator as claimed in claim 3:

wherein the heat-insulation wall is formed of urethane foam; and wherein the discrete fixing member includes a number of holes to allow a space between the pocket portions and the sealing surface to be filled with urethane foam when forming the heat-insulation wall.

5. The refrigerator as claimed in claim 1:

wherein the heat-insulation wall is formed of urethane foam; and wherein the discrete fixing member is a porous block having a plurality of through holes therethrough to allow a space between the pocket portions and the sealing surface to be filled with the urethane foam when the heat insulation wall is formed.

6. The refrigerator as claimed in claim 1:

wherein the cover is a block member having left and right slots which grasp the associated front ends of the respective left and right liners; and wherein the fixing means is a concavity in the block member.

7. A side-by-side type refrigerator comprising:

a cabinet;

a vertical partition in the cabinet forming left and right storing compartments on left and right sides thereof, the vertical partition including (a) left and right liners having respective front ends, and (b) a heat-insulation wall between the liners;

left and right doors mounted on the cabinet and having respective gaskets on inner surfaces thereof, the left and right doors opening and closing to provide access to the respective left and right compartments; and a vertical partition cover assembly which covers a front of the vertical partition, the vertical partition cover assembly including (a) a hot tube, and (b) a cover which is fitted to the front of the vertical partition to hold the hot tube , the cover including (i) left and right fitting clip sections formed at respective left and right sides of the cover which hold therein the front ends of the respective left and right liners, (ii) a solid block in which the fitting clip sections are integrally formed as slots, (iii) a flat sealing surface located at a front of the cover in contact with the gaskets of the doors when the doors are closed, and (iv) a fixing means for fixing the hot tube adjacent the sealing surface, the fixing means being a concavity integrally formed in a front surface of the solid block.

8. The refrigerator as claimed in claim 7:

wherein the sealing surface is a plate made of a magnetic material; and wherein the solid block includes opposed front edges extending forward to form a seat portion inside the front edges for the sealing plate.

9. A side-by-side type refrigerator comprising:

a cabinet, a vertical partition in the cabinet forming left and right storing compartments on left and rights sides thereof, the vertical partition including (a) left and right liners having respective front ends, and (b) a heat-insulation wall between the liners;

left and right doors mounted to the cabinet and having respective gaskets on inner surfaces thereof, the left and right doors opening and closing to provide access to the respective left and right compartments; and a vertical partition cover assembly which covers a front of the vertical partition, the vertical partition cover assembly including (a) a cover which is a block member having left and right slots which grasp the associated front ends of the respective left and right liners, and which includes (i) a sealing surface forming a plane of contact for the gaskets, and (ii) a mechanism which holds the sealing surface to the respective front ends of the liners, (b) a hot tube, and (c) a fixing means for fixing the hot tube inside of the sealing surface and laterally between the respective front ends of the liners, the fixing means being a concavity in the block member.

* * * * *